United States Patent [19]

Morimiya et al.

[11] 4,339,691

[45] Jul. 13, 1982

[54] DISCHARGE APPARATUS HAVING HOLLOW CATHODE

[75] Inventors: Osami Morimiya, Tokyo; Setsuo Suzuki; Shigeki Monma, both of Yokohama, all of Japan

[73] Assignee: Tokyo Shibaura Denki Kabushiki Kaisha, Kawasaki, Japan

[21] Appl. No.: 199,057

[22] Filed: Oct. 20, 1980

[30] Foreign Application Priority Data

Oct. 23, 1979 [JP] Japan ..... 54-136626

[51] Int. Cl.[3] ..... H01J 7/24

[52] U.S. Cl. ..... 315/111.21; 250/281; 250/426; 313/209; 313/231.31; 315/111.41; 315/335

[58] Field of Search ..... 315/111.21, 111.41, 315/111.81, 335; 313/231.31, 209; 250/426, 281

[56] References Cited

U.S. PATENT DOCUMENTS

| | | | |
|---|---|---|---|
| 2,874,296 | 2/1959 | Lofgren | 250/426 |
| 2,978,580 | 4/1961 | Von Ardenne | 313/231.31 |
| 3,004,189 | 10/1961 | Giannini | 315/111.21 |
| 3,579,027 | 5/1971 | Puter | 315/111.41 |
| 3,715,625 | 2/1973 | Ehlers | 315/111.21 |
| 4,297,615 | 10/1981 | Goebel et al. | 315/111.21 |

*Primary Examiner*—Harold A. Dixon

*Attorney, Agent, or Firm*—Oblon, Fisher, Spivak, McClelland & Maier

[57] ABSTRACT

Discharge apparatus comprises a vacuum envelope which is evacuated by a pamping apparatus. In the envelope, an anode and a hollow cathode are disposed and are connected to an arc power supply. A disk having an orfice covers one end of the hollow cathode. A low pressure gas is supplied from a gas source to the envelope through the hollow cathode and the orifice, the gas pressure in the hollow cathode being maintained higher than that in the envelope. The hollow cathode and the disk are made of an electrically conductive material and are connected to an ignition power supply. Before effecting discharging between the anode and the hollow cathode, the ignition power supply causes an ignition between the disk and the inner surface of the hollow cathode.

19 Claims, 6 Drawing Figures

DISCHARGE APPARATUS HAVING HOLLOW CATHODE

This invention relates to a discharge apparatus and, more particularly, to an arc discharge apparatus having a hollow cathode.

The hollow cathode of the arc discharge apparatus has a long life and is capable of causing relatively large current between it and anode, so that it has recently been used in high power ion sources, laser discharge apparatus and so on. However, its configuration does not permit ready emission of electrons from the surface at the time of ignition of discharge, and great electric power is required for obtaining steady discharge after causing the initial discharge. To overcome this problem, it has been in practice to provide a heater in the hollow cathode and let the cathode be preheated by supplying power to the heater so that electrons can be readily emitted at the time of the ignition of discharge. In a hollow cathode provided with a heater, however, it is not so easy to heat the cathode to emit a great number of thermal electrons, and the heater is frequently broken down. Besides, a considerably long time is required until the hollow cathode is sufficiently heated by the heater for starting the discharge.

This invention has for its object to provide a hollow cathode discharge apparatus, with which discharge can be readily caused and transition from initial discharge to steady discharge can be stably and reliably obtained.

According to the invention, there is provided a discharge apparatus comprising a vacuum envelope, an anode and a hollow cathode electrode, these electrodes being disposed within the vacuum envelope, means for supplying an arc power to maintain an arc discharge between the anode and hollow cathode, a means for evacuating the envelope, a means for supplying low pressure gas to the envelope through the hollow cathode, a means for restricting the flow of the low pressure gas supplied through the hollow cathode into the envelope such as to maintain the gas pressure in the hollow cathode to be higher than that in the envelope, and a means for causing discharge in the hollow cathode.

This invention can be more fully understood from the following detailed description when taken in conjunction with the accompanying drawings, in which.

Figure 1:
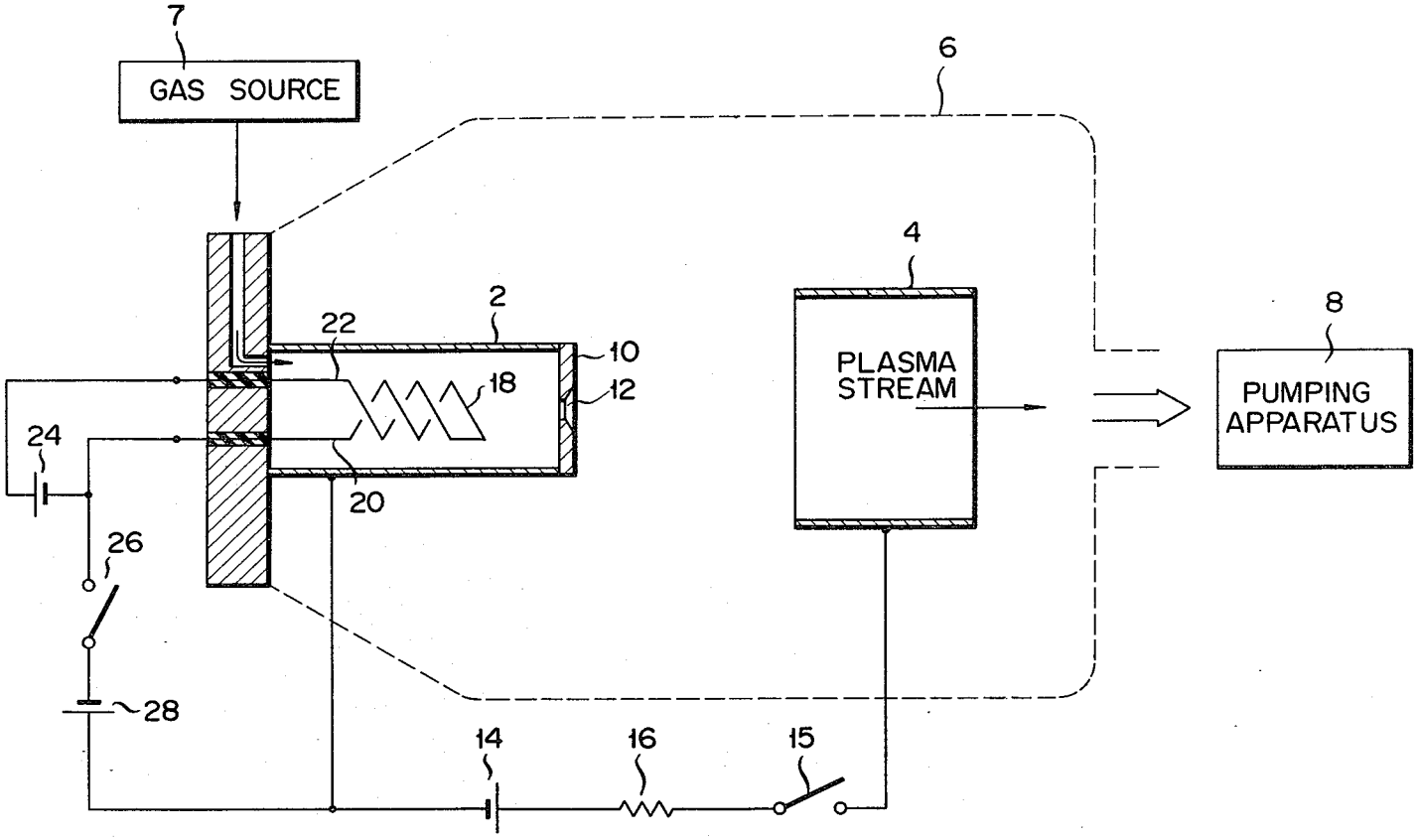
FIG. 1 is a schematic representation of an embodiment of the discharge apparatus having a hollow cathode according to the invention.

FIG. 1 schematically shows an embodiment of the discharge apparatus according to the invention applied to a power ion source. As is shown, a hollow cathode 2 and a cylindrical anode 4 are disposed in a vacuum envelope 6 which is evacuated by a pumping apparatus 8. One open end of the hollow cathode 2 is closed by a disk 10 having an orifice 12, and gas, for example hydrogen gas, under a pressure of several torr, is supplied from a gas source 7 into the hollow cathode 2 and thence through the orifice 12 into the vacuum envelope 6. The gas pressure in the hollow cathode 2 is held higher than that in the vacuum envelope 6. For example, the gas pressure in the hollow cathode 2 is held at 1 to $10^{-1}$ torr, and the gas pressure in the vacuum envelope 6 is held at $10^{-2}$ to $10^{-4}$ torr. The hollow cathode 2 is made of a refractory metal such as W, Ta and Mo or is provided on its inner surface with an electron emitter made of material having a low work function such as BaO and $LaB_6$. An arc power supply 14 for discharge, a power switch 15 and a resistor 16 for restricting the discharge current between the anode 4 and the hollow cathode 2 are connected in series between the cylindrical anode 4 and hollow cathode 2. Generally, a voltage sufficiently lower than the discharge igniting voltage determined by Paschen's law is applied at the time of the ignition of discharge between the hollow cathode 2 and anode 4 from the arc power supply 14 through the switch 15 which is closed at this time. Thus, the discharge is not caused even with this voltage applied between the hollow cathode 2 and anode 4 from the arc power supply 14. According to the invention, a discharge igniting means, which causes discharge within the hollow cathode 2 to produce many electrons therein so as to cause discharge between the hollow cathode 2 and anode 4, is provided in the hollow cathode 2. The reason for providing this means is as follows.

According to Paschen's law, the higher is the gas pressure under which discharge is to take place and which is lower than a predetermined one, the lower is the voltage required to cause discharge. Since the gas pressure within the hollow cathode 2 is held higher than that in the space between the hollow cathode 2 and anode 4 by the orifice 12, the high voltage required to cause discharge within the hollow cathode 2 is lower. In other words, inner discharge can be caused within the hollow cathode 2 without requiring much high voltage. The inner discharge caused in the hollow cathode 2 is effective to produce a plasma which is diffused in the envelope 6 and to cause discharge between the hollow cathode 2 and anode 4.

In the embodiment of FIG. 1, this discharge igniting means is a heater 18. The heater 18 is connected between pair stems 20 and 22, which are electrically insulated from the hollow cathode 2 and extend therefrom to the outside. A heater power supply 24 for supplying heater current to the heater 18 is connected between the pair stems 20 and 22. One of the stems 20 and 22 is connected through an ignition switch 26 to the negative polarity terminal of an ignition power supply 28, and the hollow cathode 2 is connected to the positive polarity terminal of the ignition power supply 28.

With this embodiment, heater current is supplied from the heater power supply 24 to the heater 18, and the inner surface of the hollow cathode 2 is heated by the heater 18 so as to emit electrons easily. When the switch 26 is closed while supplying no gas into the hollow cathode 2, the heater 18 emits electrons. These electrons bombard the inner surface of the hollow cathode 2 and thus heat the hollow cathode 2. The capacity of the heater power supply 24 can therefore be rendered relatively smaller. When a gas is supplied from the gas source 7 to the hollow cathode 2 with the switch 26 kept closed, a discharge arc is ignited between the hollow cathode 2 and the heater 18. Plasma obtained within the hollow cathode 2 diffuses toward the anode 4 through the orifice 12. As a result, a discharge arc is ignited unfailing between the hollow cathode 2 and the anode 4 with the switch 26 kept closed if the voltage of the arc power supply 14 is lower than the breakdown voltage which is determined by the gas pressure between the anode 4 and the disk 10.

Once ignited between the hollow cathode 2 and the anode 4, the discharge is maintained even if the switch 26 is opened. To make the ignition of a discharge arc more successfully, the gas pressure in the hollow cathode 2 may be raised by supplying the gas to the hollow cathode 2 at start of gas supply at a higher flow rate than in the other period of gas supply.

Further, if electron bombardment is not carried out on the hollow cathode 2 and the ignition power supply 28 is used only to ignite a discharge arc, the poles of the ignition power supply 28 may be rendered opposite to the state shown in FIG. 1.

Figure 2:
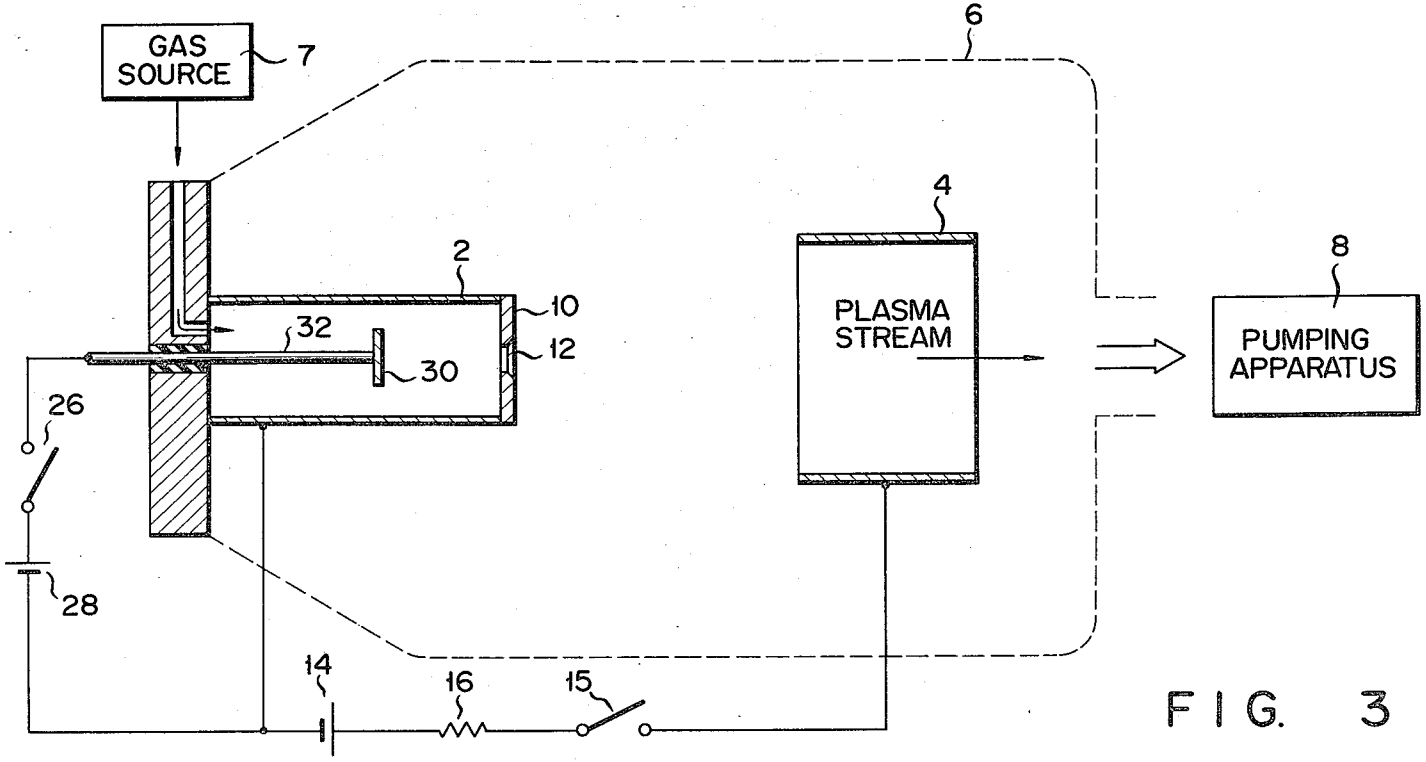
FIG. 2 is a schematic representation of another embodiment of the discharge apparatus having a hollow cathode according to the invention.

FIG. 2 shows a different embodiment of the discharge apparatus according to the invention, which will now be described. In the embodiment of FIG. 2, a disk electrode 30 is disposed within the hollow cathode 2 in lieu of the heater 18 in the preceding embodiment of FIG. 1. Unlike the preceding embodiment, in this embodiment the hollow cathode 2 is connected to the negative polarity terminal of ignition power supply 28, while the disk electrode 30 are connected through a stem 32 supporting the disk electrode 30 and the ignition switch 26 to the positive polarity terminal of the ignition power supply 28. In this embodiment, when the switch 26 is closed a discharge ignition voltage is applied between the inner surface of hollow cathode 2 and the inner surface of disk electrode 30 from the ignition power supply 28 to cause discharge, i.e., to cause emission of electrons from the inner surface of hollow cathode 2, these electrons being caused to proceed toward the disk electrode 30 which is held at a positive potential. This discharge within the hollow cathode 2 is caused at a voltage lower than that applied between the anode 4 and the hollow cathode 2 according to Paschen's law as mentioned earlier. $H_2$ gas is supplied into the hollow cathode 2. When the gas pressure within the hollow cathode 2 reaches a value in the order of $10^{-1}$ torr, a hollow cathode glow discharge takes place between the disk electrode 30 and the inner surfaces of the hollow cathode 2 and the disk 10. As a result, plasma is generated within the hollow cathode 2. The inner surface of the cathode 2 and the inner surface of the disk 10 are heated chiefly by ion bombardment, heated enough to emit electrons. When the plasma grows dense to some extent, it diffuses toward the anode 4 through the orifice 12, whereby an arc discharge occurs between the hollow cathode 2 and the anode 4. Once the discharge between the hollow cathode 2 and the anode 4 is stabilized, it is no longer interrupted even when the switch 26 is subsequently opened.

Figure 3:
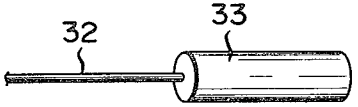
FIG. 3 is a view showing a different example of electrode 30 in the embodiment of FIG. 2.

The disk 30 in the embodiment of FIG. 2 may be replaced with a cylinder 33 as shown in FIG. 3 or with other different shapes. Also, in order to facilitate emission of electrons from the hollow cathode 2, i.e., to facilitate the discharge between the disk 30 or cylinder 33 and the hollow cathode 2, the electron emitter of the low work function, for instance one containing barium oxide, may be coated on the inner surface of the hollow cathode 2.

Figure 4:
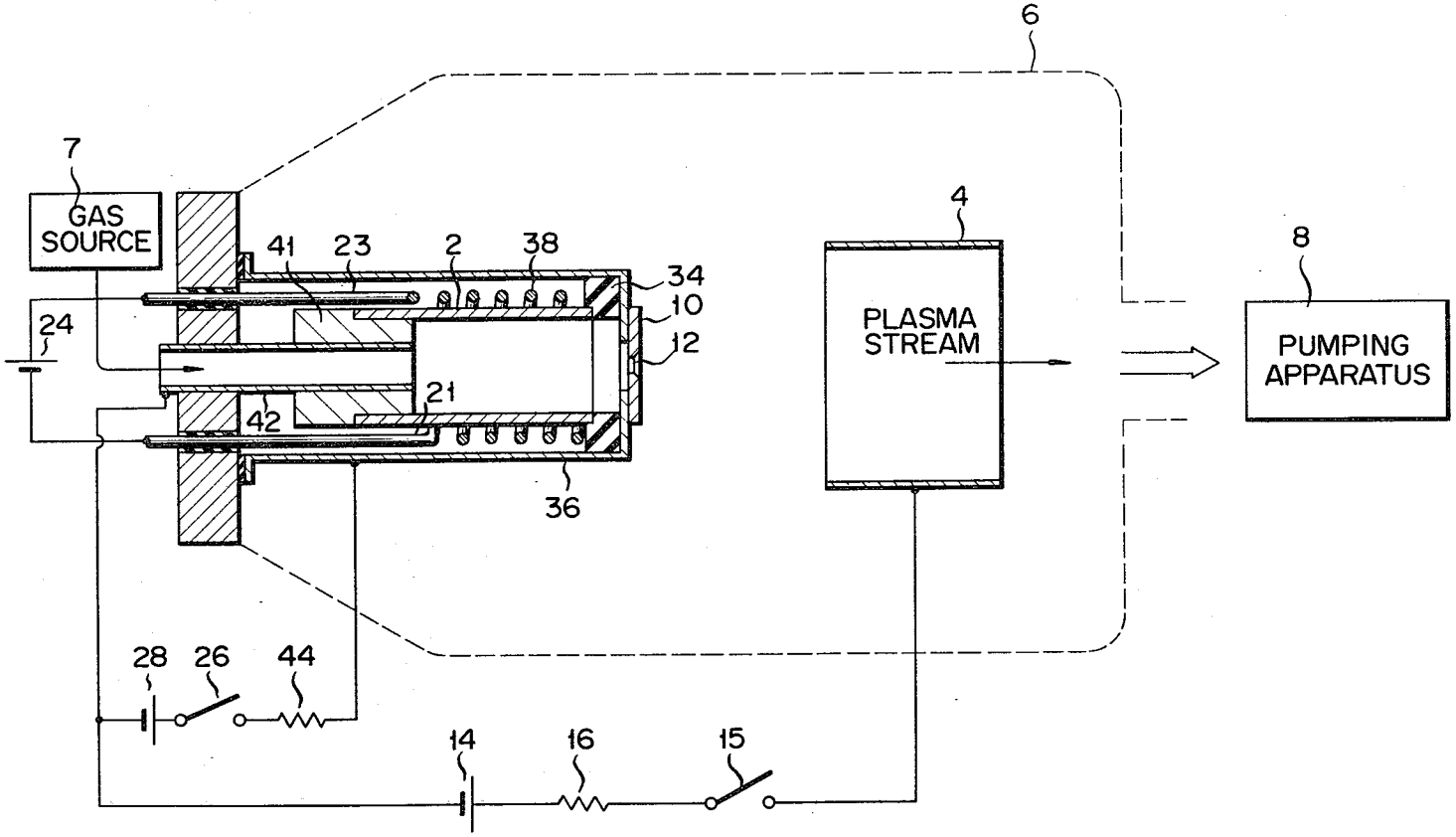
FIG. 4 is a schematic representation of a further embodiment of the discharge apparatus having a hollow cathode according to the invention.
Figure 5:
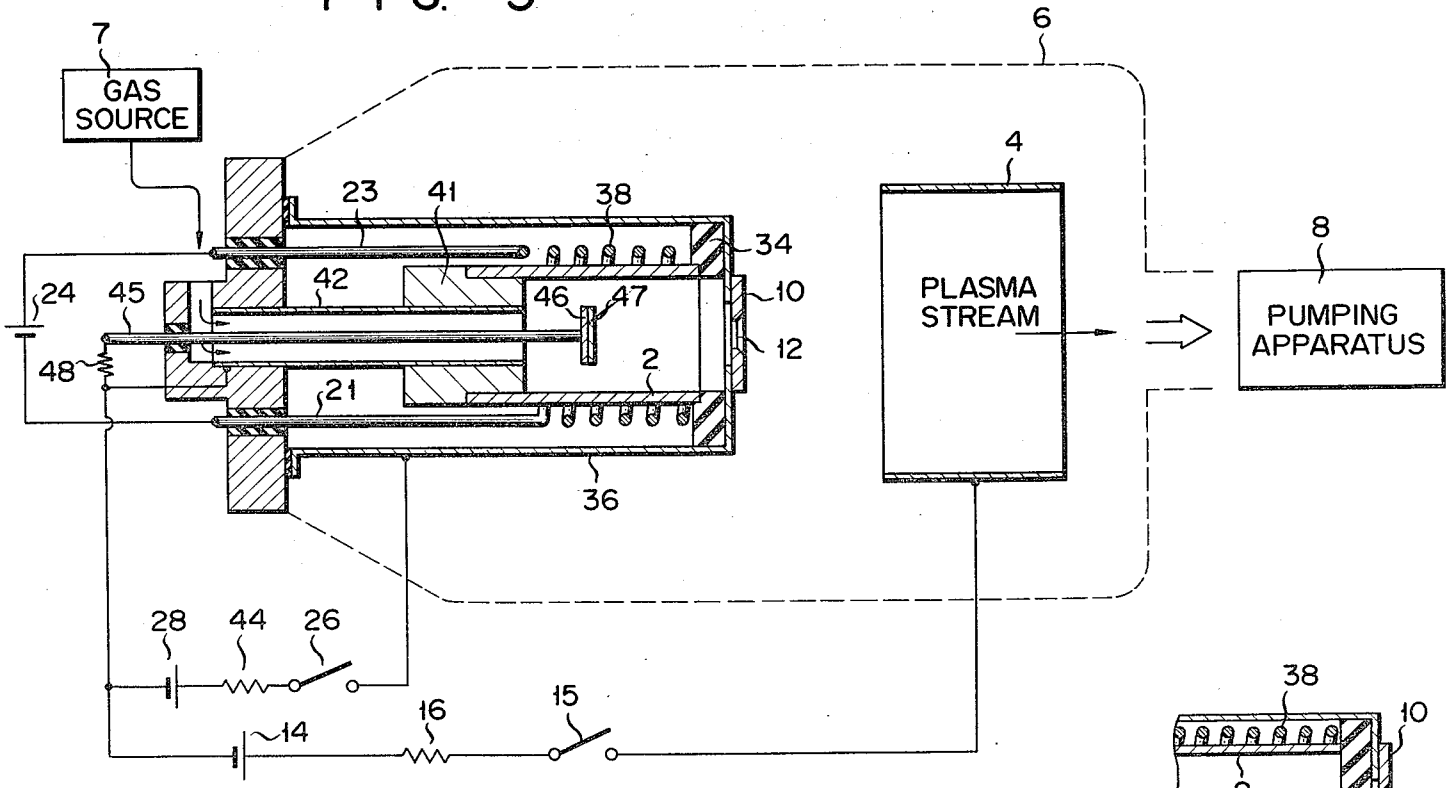
FIG. 5 is a schematic representation of a still further embodiment of the discharge apparatus having a hollow cathode according to the invention.
Figure 6:
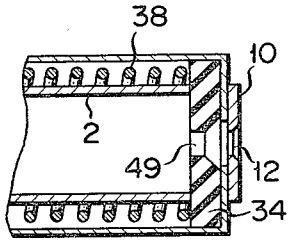
FIG. 6 is a partial schematic representation of a modified embodiment of FIGS. 4 and 5.

FIGS. 4, 5 and 6 show further embodiments. In these embodiments, the disk 10 provided with the orifice 12 are made of a conductive metal and mounted on one open end of hollow cathode 2 via insulating ring 34 made of a material capable of withstanding high temperatures such as boron nitride (BN). In order to prevent dissipation of heat from the hollow cathode 2 to the outside, the hollow cathode 2 is accommodated in a heat shield housing 36 in a state electrically insulated therefrom. The heat shield housing 36 is made of an electric conductive metal and electrically connected to the disk 10. Preferably, a heater 38 for heating the hollow cathode 2 may be provided on the outer periphery thereof. Also, as shown in the embodiment of FIG. 4, the hollow cathode 2 is made of an electron emitter material capable of readily emitting electrons. A pair of power supply stems 21 and 23 extending from the heater 38 through the housing 36 are let out to the outside thereof and connected to the heater power supply 24. The hollow cathode 2 is supported by the supporting ring 41 which is coupled to a conductive metal cylinder 42 within the housing 36 in a state electrically insulated therefrom, and is electrically connected through the supporting ring 41 and conductive metal cylinder 42 to the negative polarity terminal of ignition power supply 28 and also the negative polarity terminal of arc power supply 14. The housing 36 is connected through resistor 44 and discharge start switch 26 to the positive polarity terminal of ignition power supply 28. The housing 36 is provided with gas inlet pipe for supplying low pressure gas into the hollow cathode 2. In the embodiment of FIG. 5, disk electrode 46 is disposed within the hollow cathode 2 and is connected through a stem 45 supporting the disk electrode 46 and a resistor 48 to the negative polarity terminals of ignition and arc power supplies 28 and 14. Preferably, an electron emitter layer 47 is provided on the surface of the disk electrode 46. It is possible to replace the electrode 46 in the embodiment of FIG. 5 with one having any other shape. In this embodiment, unlike the embodiment of FIG. 4, the electrode 46 can be desirably positioned with respect to the disk 10 and can thus be located in a predetermined position, in which the discharge ignition voltage determined according to Paschen's law is minimum. The hollow cathode 2 may be made of the electron emitter material same as the embodiment of FIG. 4.

In the embodiments of FIGS. 4 and 5, discharge is caused between the disk 10 and the hollow cathode 2 or the electrode 46, and it can reliably bring about discharge between the hollow cathode 2 and the anode 4. More particularly, the hollow cathode 2 is heated by the heater 38 and rendered into a state capable of readily emitting electrons, and by subsequently closing the switch 26 discharge can be readily caused between the disk 10 and hollow cathode 2 or electrode 46. With this discharge, plasma is produced within the hollow cathode 2 to heat the inner surface of the hollow cathode 2. With the closure of the switch 15 a high voltage is applied between the hollow cathode 2 and the anode 4, and arc discharge is caused between these electrodes and is subsequently stabilized.

FIG. 6 shows modified embodiment of discharge apparatus according to this invention, which differs from the embodiments of FIGS. 4 and 5 only in that a second orifice 49 is provided. The second orifice 49 is a through hole made in the insulator 34 located between one end of the hollow cathode 2 and the electric conducting disk 10. The insulator 34 is made of material resistant to a high temperature, such as $Al_2O_3$ and BN.

Since two orifices 12 and 49 are provided, resistance to the gas which flow through the hollow cathode 2 and envelope to the pumping apparatus 8 increases, thus raising the gas pressure within the hollow cathode 2 even if a gas is supplied to the hollow cathode 2 at the same flow rate. Moreover, since the orifice 49 is defined by the insulator 34, the electric field generated by the disk 10 can easily penetrate through the insulator 34 into the hollow cathode 2. This facilitates ignition of a discharge arc.

In any embodiments of FIGS. 1 to 6 the discharge arc can be ignited more easily and more successfully if gas is supplied from the gas source to the hollow cathode at a high flow rate at the start of gas supply and then at a low flow rate at the time of stable discharge being maintained.

The gas supplied from the gas source is not limited to $H_2$. Other gases such as rare gas and metal vapor can be used instead.

As has been described, according to the invention discharge is first caused within the hollow cathode, in which the discharge can be readily caused, and then discharge is caused between the hollow cathode and anode. Thus, it is possible to obtain steady discharge reliably without requiring great power at the time of the start of discharge.

What we claim is:

1. A discharge apparatus comprising:

a vacuum envelope;

an anode and a hollow cathode disposed within said vacuum envelope;

means for supplying an arc power to maintain an arc discharge between said anode and hollow cathode;

a means for evacuating said envelope;

a means for supplying gas under a low pressure through said hollow cathode into said envelope;

a means for restricting the flow of the low pressure gas supplied from said hollow cathode into said envelope such as to maintain the gas pressure within said hollow cathode to be higher than that within said envelope; and a means for causing discharge within said hollow cathode.

2. A discharge apparatus according to claim 1, wherein said gas supply means supply a gas at a high flow rate at the start of gas supply and then at a low flow rate at the time of stable discharge.

3. A discharge apparatus according to claim 1, wherein said discharge means includes a heater provided within said hollow cathode and insulated from said hollow cathode, means for supplying heater current to said heater, and means for supplying an ignition power between said hollow cathode and heater to cause discharge between said hollow cathode and heater.

4. A discharge apparatus according to claim 3, wherein said ignition power supplying means provides a positive potential to said hollow cathode.

5. A discharge apparatus according to claim 1, wherein said discharging means includes an electrode provided within said hollow cathode and means for supplying an ignition power between said electrode and hollow cathode to cause discharge between said electrode and hollow cathode.

6. A discharge apparatus according to claim 5, wherein said electrode is in the form of a disk.

7. A discharge apparatus according to claim 5, wherein said electrode is in the form of a cylinder.

8. A discharge apparatus according to claim 5, wherein said ignition power supplying means provides a positive potential to said electrode.

9. A discharge apparatus according to claim 1, wherein said hollow cathode is made of an electron emitter material.

10. A discharge apparatus according to claim 1, which further comprises a heat shield means provided on the outer periphery of said hollow cathode for minimizing heat dissipation from said hollow cathode.

11. A discharge apparatus according to claim 10, wherein said means for restricting gas flow is a conductive plate provided on an open end of said follow cathode and formed with an orifice, and also wherein said discharging means includes means for supplying an ignition power between said conductive plate and the inner surface of said hollow cathode to cause discharge between said conductive plate and hollow cathode.

12. A discharge apparatus according to claim 10, wherein said hollow cathode is made of an electron emitter material.

13. A discharge apparatus according to claim 10, wherein said ignition power supplying means provides a positive potential to said conductive plate.

14. A discharge apparatus according to claim 10, wherein further comprises a heater provided on the inner periphery of said hollow cathode for heating said hollow cathode and means for supplying heater current to said heater.

15. A discharge apparatus according to claim 1, wherein said means for restricting said gas flow is a conductive plate provided on one open end of said hollow cathode and formed with an orifice, and also wherein said discharging means includes an electrode provided within said hollow cathode and means for supplying an ignition power between said conductive plate and electrode to cause discharge between said conductive plate and electrode.

16. A discharge apparatus according to claim 15, wherein said electrode includes an electron emitter layer provided on the surface.

17. A discharge apparatus according to claim 15, wherein said ignition voltage supplying means provides a positive potential to said conductive plate.

18. A discharge apparatus according to claim 15, which further comprises a heat shield means provided on the outer periphery of said hollow cathode for minimizing heat dissipation from said hollow cathode electrode.

19. A discharge apparatus according to claim 15, which further comprises a heater provided on the inner periphery of said hollow cathode for heating said hollow cathode and means for supplying heater current to said heater.

* * * * *